US005080438A

United States Patent [19]

Moyer

[11] Patent Number: 5,080,438

[45] Date of Patent: Jan. 14, 1992

[54] FURNITURE STRUCTURE AND METHOD

[76] Inventor: Robert W. Moyer, 1 Daves Creek Rd., Franklin, N.C. 28734

[21] Appl. No.: 600,734

[22] Filed: Oct. 22, 1990

Related U.S. Application Data

[63] Continuation of Ser. No. 414,303, Sep. 29, 1989, abandoned.

[51] Int. Cl.[5] ..... A47C 7/00

[52] U.S. Cl. ..... 297/440; 297/444

[58] Field of Search ..... 297/440, 441, 443, 444; 108/157; 248/188, 188.1

[56] References Cited

U.S. PATENT DOCUMENTS

| | | | |
|---|---|---|---|
| 488,095 | 12/1892 | Scott et al. | 297/444 |
| 3,221,348 | 12/1965 | Siegel | 297/443 X |
| 3,774,966 | 11/1973 | Faulkner et al. | 297/440 |
| 3,856,345 | 12/1974 | Beckley | 297/440 X |
| 4,300,455 | 11/1981 | Ornati | 297/440 X |
| 4,301,985 | 11/1981 | Ballard | 297/440 X |
| 4,523,787 | 6/1985 | Robinson | 297/444 |
| 4,621,381 | 11/1986 | Schramek | 297/440 X |
| 4,848,839 | 7/1989 | Galardo | 297/440 |
| 4,928,244 | 5/1990 | Nava | 297/440 |

FOREIGN PATENT DOCUMENTS

| | | | |
|---|---|---|---|
| 963369 | 10/1949 | Fed. Rep. of Germany | 297/444 |
| 1034114 | 7/1953 | France | 297/443 |
| 360380 | 6/1938 | Italy | 297/440 |

*Primary Examiner*—José V. Chen

[57] ABSTRACT

Furniture structure which is easy to assemble and disassemble includes upholstered frame sections with biased members. The engagement of the biased members provides a strong, durable construction with a substantially imperceptible joint. Unskilled persons can assemble the structure with simple hand tools quickly and efficiently to form furniture which has an expensive, stylish appearance yet which is economical to purchase.

8 Claims, 3 Drawing Sheets

FURNITURE STRUCTURE AND METHOD

This is a continuation of application Ser. No. 07/414,303 filed Sept. 29, 1989, now abandoned.

BACKGROUND OF THE INVENTION

1. Field Of The Invention

The invention herein pertains to a furniture structure and method to provide relatively low cost which is easily assembled and disassembled by unskilled persons that will appear as expensive furniture due to the joints which are rigid and durable yet relatively imperceptible.

2. Description Of The Prior Art And Objectives Of The Invention

It has become increasingly popular in recent years for consumers to buy furniture of the "knock-down" type whereby the furniture is shipped from a factory to the consumer and thereafter the consumer assembles the furniture for apartments, dormitory rooms and the like. Such furniture has generally been classified as "low end" furniture since assembly techniques and the construction needed to ensure ease in assembly is readily apparent when completed and in use. For example, knock-down upholstered furniture, upon assembly, conventionally appears with a series of joints which are visually obvious even to the casual observer. These joints which can be loose and weak make the furniture appear inexpensive and detract from its overall strength and appearance. While many furniture manufacturers desire to build knock-down furniture utilizing more expensive fabrics and frames, the assembled appearance of simple-to-assemble furniture has generally not been totally pleasing to the consumers and attempts at "high end" pieces have largely been unsuccessful.

Therefore, with the disadvantages and problems known of conventional knock-down upholstered furniture, the present invention was conceived and one of its objectives is to provide a satisfying furniture structure for the discriminating purchaser which is relatively easy to assemble by unskilled personnel.

It is another objective of the present invention to provide a furniture structure and method for assembly having joints which are very strong but substantially imperceptible to the casual viewer.

It is still another objective of the present invention to provide a furniture structure which is relatively lightweight, yet which is durable and which can be incorporated into chair, loveseat, sofa or other furniture structures as desired.

It is still yet another objective of the present invention to provide a furniture structure and method which includes sections having upholstered biased frame members which cooperatively engage during assembly to provide a relatively imperceptible joint.

Various other objectives and advantages of the present invention become apparent to those skilled in the art as a more detailed description is presented below.

SUMMARY OF THE INVENTION

The aforesaid and other objectives are realized by a furniture structure which consists of a back, seat and side sections which are upholstered and are ready to easily assemble by relatively unskilled persons. Biased mating surfaces are provided which allow the structure to assemble with high strength and relatively imperceptible joints. The method herein includes forming a pair of sectional frames having biased end members, upholstering the frames and thereafter assembling the frames with bolts or other means to secure the biased member in rigid engagement.

DESCRIPTION OF THE PREFERRED EMBODIMENT

Figure 1:
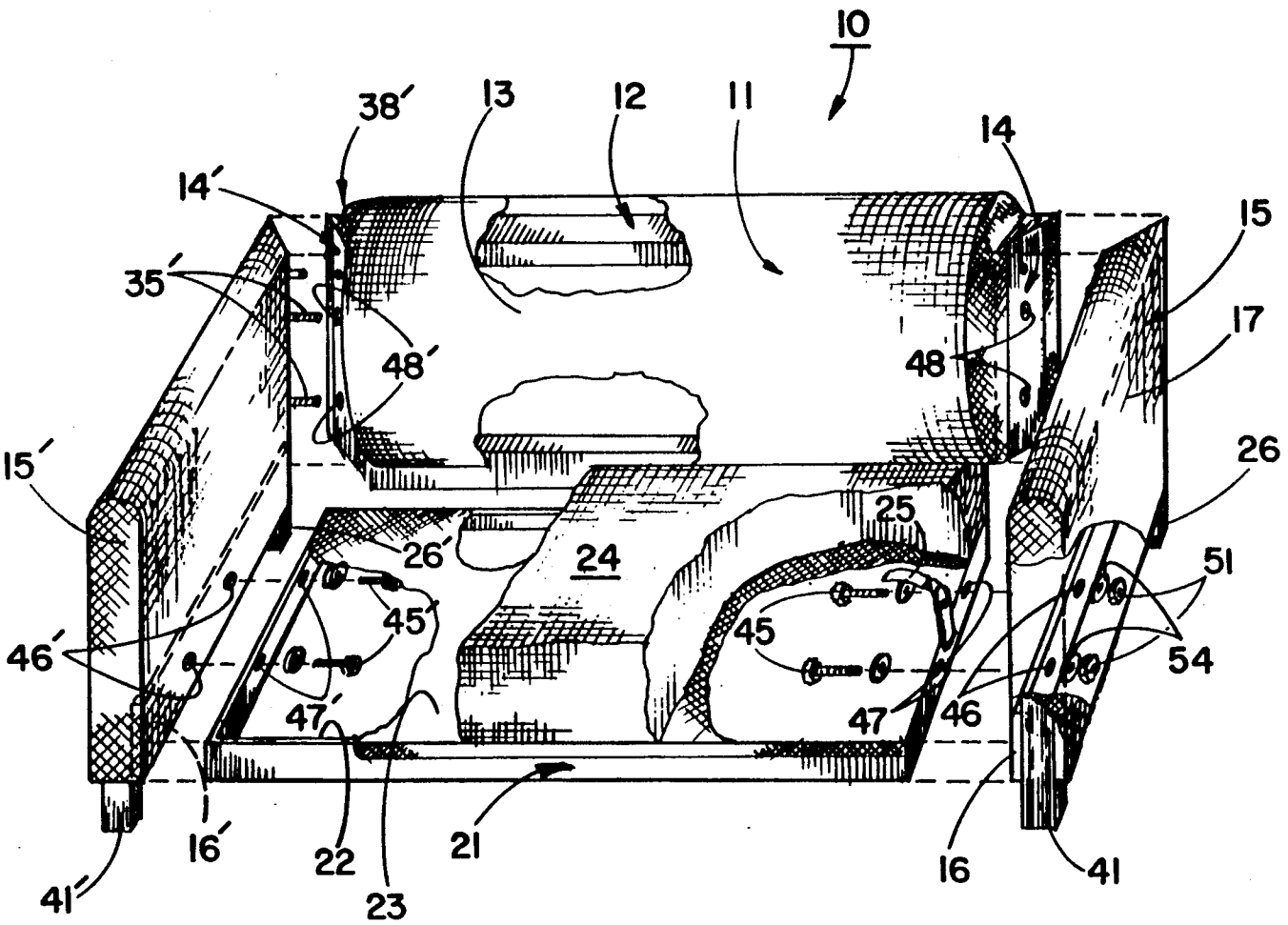
FIG. 1 illustrates a loveseat structure of the present invention.

The preferred form of the furniture structure of the invention comprises as loveseat as shown in FIG. 1 which includes a back section, a seat section and two side sections constructed to easily assemble and disassemble. All sections are formed by the use of rectangular wooden frames and are covered with a conventional upholstery fabric with padding as needed and a removable seat cushion is also provided. The back section includes a pair of end members which have biased ends which cooperatively engage complementary biased members of the side sections. Threaded studs are permanently affixed in the surface of the biased end members of the side sections for insertion through apertures in the biased members of the back section. Aligning studs are also affixed to the biased member of the side sections to ensure correct alignment and sturdiness of the structure when assembled. The seat section is affixed with threaded bolts to the side sections and the seat cushion has a latch strap for affixing it to the side section also. The structure of FIG. 1 can be easily assembled using only hand tools by unskilled persons. The side sections include legs, and the rear legs of the side sections have a biased segment for engaging the biased end member of the back section.

The preferred method of the invention comprises forming the various sections in independent fashion, by first forming a frame which may be for example, a back sectional frame with a first biased end member. Thereafter the back sectional frame is covered including the biased end member. Next a side sectional frame is formed from wood with a biased member. Thereafter the side sectional frame is covered and the first (back) section is joined to the second (side) section whereby the biased members combine to form a strong, relatively imperceptible joint. The other sections are then joined to form a finished structure such as a loveseat.

DETAILED DESCRIPTION OF THE INVENTION AND METHOD OF ASSEMBLY

Figure 4:
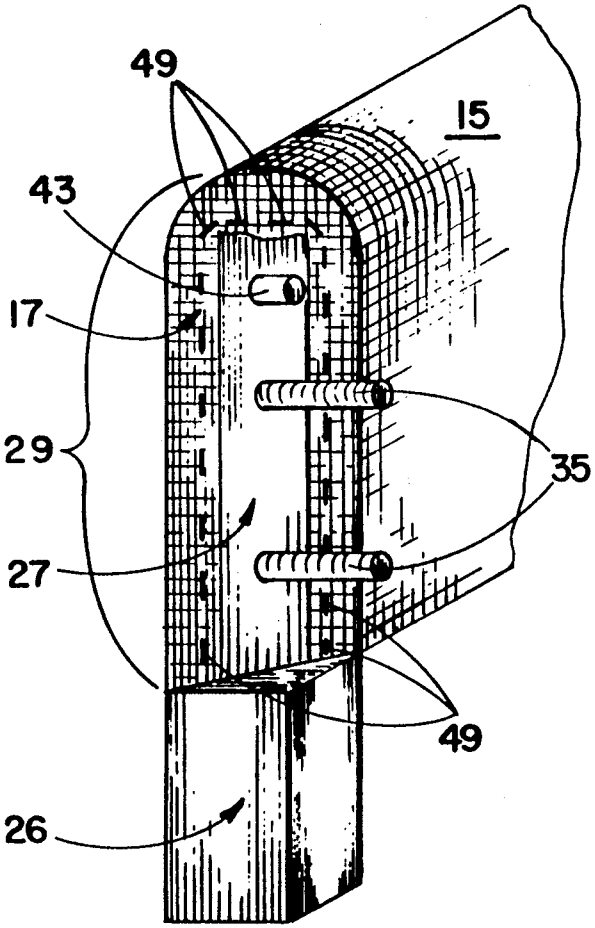
FIG. 4 shows a view of the side along lines 4—4 as seen in FIG. 2.

For a more complete understanding of the invention, turning now to the drawings, FIG. 1 illustrates in exploded fashion furniture structure 10 comprising what is commonly referred to as a loveseat although other structures may be likewise constructed such as for example, sofas and chairs or other furniture pieces. Furniture structure 10 includes a first back section 11, a first wooden frame 12, a first cover or fabric 13 which may consists of conventional upholstery fabric. Frame 12 includes first biased frame end members 14 and 14'. A portion of the upholstered portion consists of overhang 38' which partially covers the top of left biased frame end member 14' as shown in FIG. 1 and such (overhang 38) has been removed on right side biased frame end member 14 to show the triangular shaped cross section of end member 14 with hypotenuse-like surface 18. A second section 15 which is the side section, includes a second frame 16, also shown in FIG. 1 and includes front leg 41, and a rear leg 26 having a biased hypotenuse-like surface 27 (FIG. 4). A left side section 15' is also shown in FIG. 1 with frame 16', a front leg 41' and a rear leg 26'.

Leg 26 is shown more clearly in FIG. 4 with biased surface 27. Leg 26 includes a lower substantially rectangular cross section portion having top surface 28 which is exposed below upholstered side section 15 and includes a substantially triangular cross section upper portion 29 with biased or hypotenuse-like surface 27. To secure side section 15 to back section 11, a means is also shown in FIG. 4 in the form of threaded studs 35 which are permanently affixed to leg segment 29 of leg 26. Support stud 43 is also shown in FIG. 4 and one or more such support studs may be added to increase the structural integrity of structure 10 when assembled. Seat section 21 includes wooden seat frame 22, seat support 23 consisting of canvas, Dymetrol (a Dupont trademark) or other durable fabrics. Cushion 24 is a conventional polyurethane filled fabric cushion although other types or styles could be utilized as desired. Cushion 24 is attached to side frame 16 by adjustable strap assembly 25, shown unaffixed to frame 16 in FIG. 1.

Figure 5:
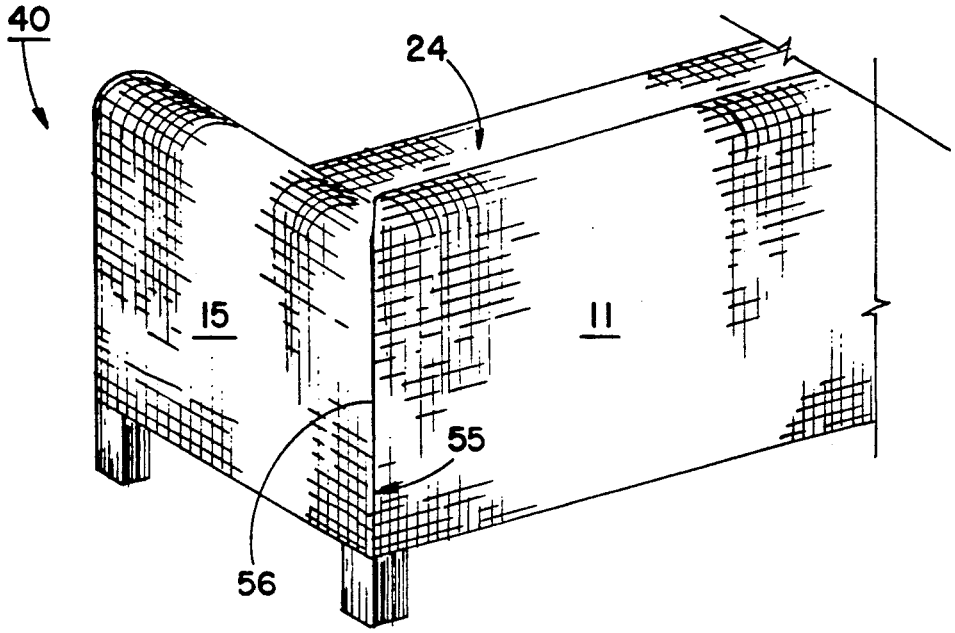
FIG. 5 shows a rear view of the corner of the assembled furniture structure as shown in FIG. 3.
Figure 2:
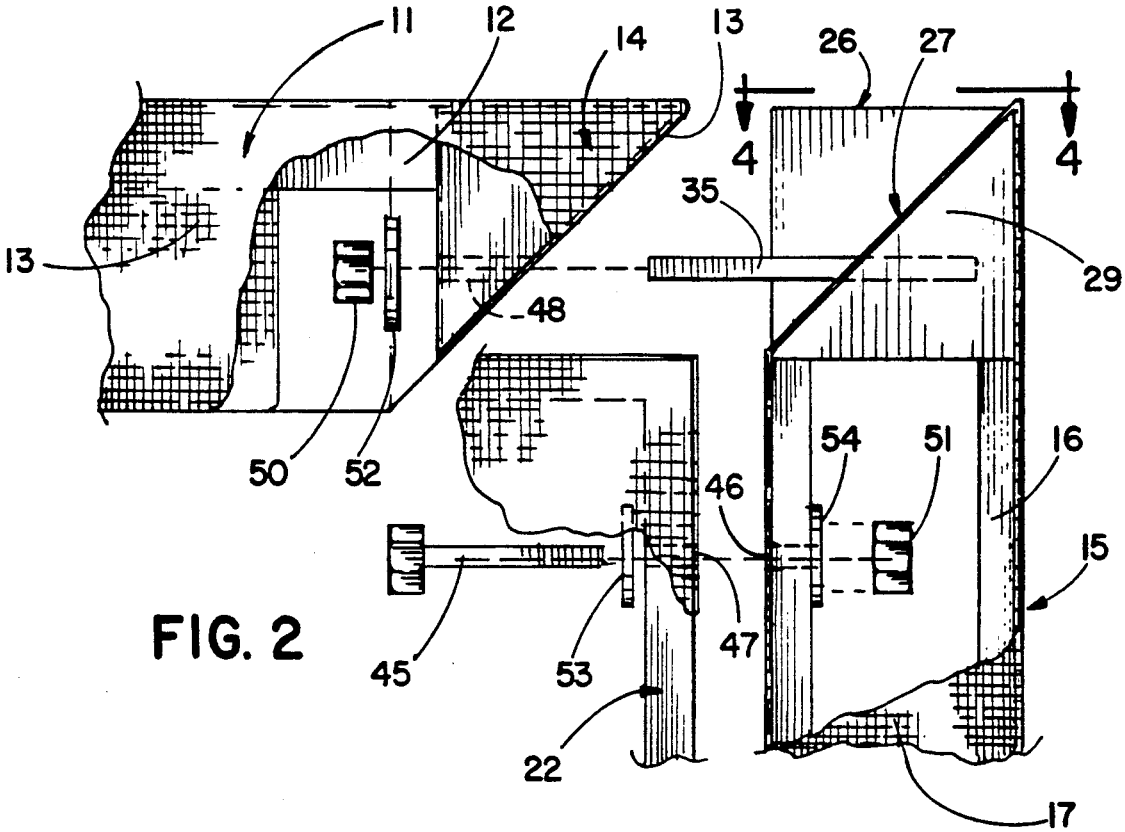
FIG. 2 demonstrates a partial cut-away top view of the right rear corner of the loveseat as shown in FIG. 1.
Figure 3:
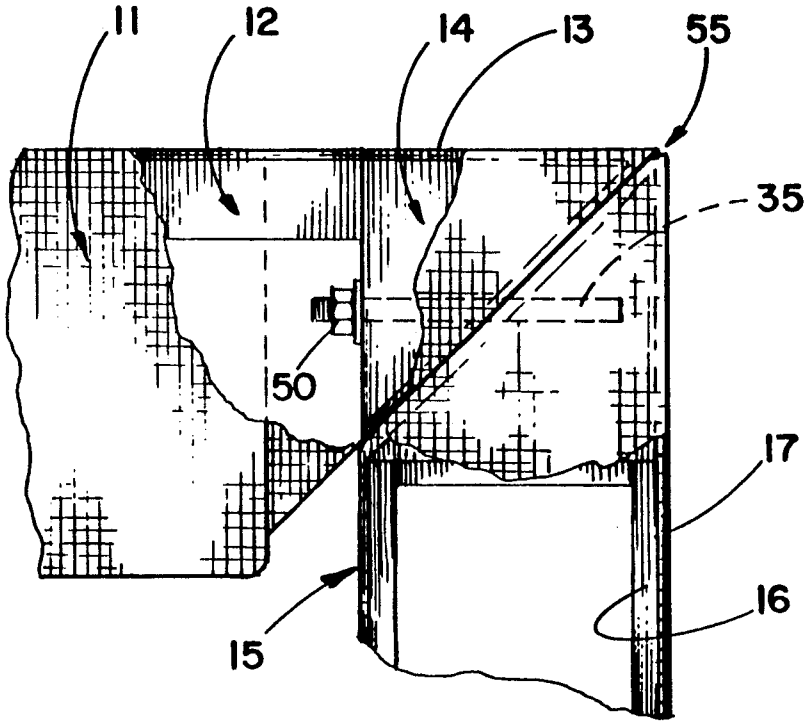
FIG. 3 illustrates an assembled version of the right rear side and back of the corner as shown in FIG. 2.

As further seen in FIG. 1, seat section 21 is bolted to side sections 15 and 15' respectively by bolts 45 and 45' which pass through apertures 46 and 46' respectively in side sections 15 and 15' and threaded studs 35, 35' pass through apertures 48, 48' in biased back end members 14, 14'. Nuts 51, (51' not seen) secure bolts 45, (45' not seen) respectively and comparable nuts 50, (50' not seen) are used on threaded studs 35, (35' not seen) (See FIG. 2). Washers 53, 54 are used on bolt 45, as further demonstrated in FIG. 2, a close up of the rear corner of structure 10 is depicted in a partially cut-away configuration. Side 15 is affixed by threaded studs 35 which pass through apertures 48 and are secured to back section 11 by nut 50 and washer 52. As would be understood, biased end member 14 through hypotenuse-like surface 18 cooperatively engages biased hypotenuse-like surface 27 of leg 26 with end member 14 resting on top surface 28 as would be understood from FIG. 2 to form a relatively imperceptible outside joint 55 as shown in FIG. 5. Top view of joint 55 is shown in FIG. 3 upon completion of assembly. FIG. 3 illustrates side section 15 with frame 16 which is covered with fabric 17 prior to assembly with back section 11. As would be understood from FIG. 4, cover 17 is affixed to biased or hypotenuse-like surface 27 by staples 49 placed therein. As earlier mentioned, various furniture structures such as chairs, sofas and other upholstered furniture pieces can be formed and easy-to-assemble or "knock down" style and can be later assembled with strong, relatively imperceptible joints utilizing the structure as taught herein. As would be understood, legs using biased surfaces for engagement, additional strength is achieved by this "triangular" construction.

The method of assembly of structure 10 is relatively easy as the method includes forming a first frame such as 12 with a biased end member 14 hypotenuse-like surface 18 as shown in FIG. 1, said first frame 12 including the biased end member 14 covered with an upholstered fabric 13. Next, the method includes forming a second frame 16 with a biased leg member 26 which has hypotenuse-like surface 27 complementary to first biased end member 14. Second frame 16 is covered with a said second cover member 17 and thereafter said first frame 12 is joined to said second frame member 16 whereby the covered biased members 14, 26 engage to form a relatively imperceptible joint 55 (FIG. 5). Additionally, the upholstery fabric or cover selected can be varied in color, design and texture. Thus, a substantially soft or high plush fabric can be utilized to further diminish the joint line 56 as demonstrated in FIG. 5 to give the furniture a "factory" upholstered and assembled look.

The illustrations and examples provided herein are for explanatory purposes and are not intended to limit the scope of the appended claims.

I claim:

1. A furniture structure comprising: a side frame, said side frame comprising a post leg, said leg comprising a rectangular cross section with a top and bottom, a triangular segment extending upwardly from said top, the hypotenuse of said triangular segment bisecting and extending substantially from one corner of the rectangular cross section to the other, a back frame, said back frame comprising a triangular shaped end member complimentarily engaging with said triangular segment of said side frame whereby said triangular shaped end member rests upon the top of said post rectangular cross section thereby forming a furniture structure with a substantially imperceptible joint.

2. Furniture structure as claimed in claim 1 and including means to releasably secure said post leg to said end member.

3. Furniture structure as claimed in claim 1 wherein said securing means extends through said post leg.

4. Furniture structure as claimed in claim 1 wherein said securing means includes a threaded stud.

5. Furniture structure comprising: a back, a seat, a pair of sides, said sides joined to said back and said seat, said back comprising a pair of end members, each of said end members having a triangular configuration, a pair of post legs, each of said pair of said post legs comprising a rectangular cross section having a top and a bottom, a triangular segment extending upwardly from said top, the hypotenuse of said triangular segment bisecting and extending substantially from one corner of the rectangular cross section to the other, each of said triangular segments engaging one of said triangularly configured end members to form substantially imperceptible rectangular configured joints.

6. Furniture structure as claimed in claim 1 wherein said back, seat and pair of sides are upholstered.

7. Furniture structure as claimed in claim 1 and including a threaded stud, said stud extending from said back end member through said triangular segment.

8. Furniture structure as claimed in claim 1 wherein each of said back end members includes a stud receiving aperture.

* * * * *